US007805806B2

(12) United States Patent
Linhart et al.

(10) Patent No.: US 7,805,806 B2
(45) Date of Patent: Oct. 5, 2010

(54) HANDLE ARRANGEMENT ON A SUCTION HOSE

(75) Inventors: Georg Peter Linhart, Wöllstadt (DE); Christian Norbert Linhart, Langgöns (DE)

(73) Assignee: Truplast Kunststofftechnik GmbH, Langgöns (DE)

( * ) Notice: Subject to any disclaimer, the term of this patent is extended or adjusted under 35 U.S.C. 154(b) by 87 days.

(21) Appl. No.: 12/378,024

(22) Filed: Feb. 10, 2009

(65) Prior Publication Data

US 2009/0205163 A1 Aug. 20, 2009

(30) Foreign Application Priority Data

Feb. 14, 2008 (DE) ..... 10 2008 009 389

(51) Int. Cl.
*A47L 9/00* (2006.01)

(52) U.S. Cl. ..... 15/410; 15/143.1; 15/344

(58) Field of Classification Search ..... 15/410, 15/411, 143.1–145, 344; 16/110.1, 111.1; 81/489, 490
See application file for complete search history.

(56) References Cited

U.S. PATENT DOCUMENTS

| | | | | |
|---|---|---|---|---|
| 5,189,755 | A | 3/1993 | Yonkers et al. | |
| 5,400,462 | A | 3/1995 | Amoretti | |
| 5,459,901 | A | 10/1995 | Blase et al. | |
| 6,015,298 | A * | 1/2000 | Linhart | 439/24 |
| 6,353,178 | B1 * | 3/2002 | Linhart | 174/47 |
| 6,392,150 | B2 * | 5/2002 | Linhart | 174/82 |
| 6,722,904 | B2 * | 4/2004 | Linhart | 439/191 |
| 6,733,315 | B2 * | 5/2004 | Linhart | 439/191 |
| 2009/0031526 | A1 * | 2/2009 | Linhart et al. | 15/410 |

FOREIGN PATENT DOCUMENTS

| | | |
|---|---|---|
| DE | 692 31 070 T 2 | 9/2000 |
| GB | 2 291 795 A | 2/1996 |
| WO | WO 2004/073478 A1 | 9/2004 |

* cited by examiner

*Primary Examiner*—Dung Van Nguyen
(74) *Attorney, Agent, or Firm*—Reising Ethington P.C.

(57) ABSTRACT

A handle arrangement on a suction hose equipped for spray extraction has a bushing non-rotatably attached to one end of the hose, and is inserted in a handle tube and axially fixed therein such that it can rotate in the tube. An elastic liquid line is guided outwards from the hose and the inner bushing in a radial direction through a wall opening of the handle tube and into the cavity of a handle part. The handle part is firmly connected at both ends to the handle tube. The liquid line is fixed so as to form a length reserve loop in the cavity. A receiving space is provided on the inner bushing, into which the liquid line from the length reserve loop is shifted when relative rotations take place between the hose and the handle tube.

10 Claims, 5 Drawing Sheets

HANDLE ARRANGEMENT ON A SUCTION HOSE

TECHNICAL FIELD

The invention relates to a handle arrangement on a suction hose equipped for spray extraction. In the method known as spray extraction, a cleaning agent in liquid form is sprayed into the carpet pile under pressure by means of a spray extraction device and is sucked up in one pass by means of a suction device via a suction hose. In a similar method, a cleaning agent in powder form is blown into the carpet pile and is sucked up in one pass by means of a suction device via a suction hose. Therefore, when mention is made below of a liquid line, this term is also intended to encompass a line through which a cleaning powder is blown.

PRIOR ART

In the devices used here, a liquid line is guided internally through the suction hose, which is provided at its handling end with a handle arrangement which is attached to the suction hose such that it can rotate to a limited extent relative to the suction hose. Here, the liquid line is guided outwards at the point of the transition from the suction hose to the handle arrangement according to the prior art and is usually fixed externally on the handle arrangement. This design has the disadvantage that the liquid line is not protected in the region of the handle arrangement and can become caught up-during use.

It has already been proposed to guide the liquid line internally through a handle part of the handle arrangement. In this case, however, the desired rotatability of the handle arrangement relative to the suction hose is considerably restricted.

What is needed is to provide a handle arrangement on a suction hose equipped for spray extraction, in which, despite the fact that the suction line is guided through a handle part, the possible rotation angle between the suction hose and the handle arrangement is large enough to ensure convenient handling during spray extraction.

SUMMARY OF THE INVENTION

The invention is directed to a handle arrangement on a suction hose equipped for spray extraction. The handle arrangement includes an inner bushing which is attached to one end of the suction hose such that it cannot rotate relative to the suction hose and a handle tube in which the inner bushing is inserted and is fixed therein in a sealed manner such that it can rotate but cannot be displaced in the axial direction. A flexible liquid line is guided outwards from the suction hose and the inner bushing in an approximately radial direction through a wall opening of the handle tube and into a cavity of a handle part which is connected to the hose-side end of the handle tube. The liquid line is fixed so as to form a length reserve loop in the handle part. A receiving space is provided on the outer circumference of the inner bushing, which receiving space is located opposite the wall opening of the handle tube and into which the liquid line from the length reserve loop can be shifted in the case of relative rotations between the suction hose and the handle tube, and wherein the rotation angle between the suction hose and the handle tube is delimited according to the length of the liquid line in the length reserve loop.

The handle arrangement according to the invention allows a rotation angle between the suction hose and the handle arrangement of up to approximately 180° and more, which ensures convenient handling of the arrangement during spray extraction. It has been found that a length reserve loop formed of the flexible liquid line itself and arranged in the specified manner allows the specified rotation angle. Here, the length of the liquid line located in the length reserve loop limits the rotation angle between the suction hose and the handle tube. However, this rotation angle can also preferably be delimited by stops.

In the case of relative rotations between the suction hose and the handle arrangement, the receiving space on the circumference of the inner bushing takes up the flexible liquid line without any kinks. The liquid line is also returned to the length reserve loop without any kinks in the rest position, once the handle arrangement and hose have again reached their relative starting position. The stops, which are effective in both directions of rotation, prevent any over-expansion or stretching of the liquid line, which even at the stop positions assumes a curved position which favours the return to the rest position of the length reserve loop. Here, the liquid line is supported at its fixing point in the handle part.

In continuation of the concept of the invention, the handle part can be formed of two half-shells which at one side partially tightly surround the handle tube at its suction-hose-side end and at the other side are also connected to the other end of the handle part, wherein the two half-shells form a cavity passing through the handle part, through which cavity the liquid line is guided and is fixed in the vicinity of the handle tube by a line holder. The handle tube and handle part then form a one-piece handle arrangement which can rotate to a limited extent relative to the suction hose connected thereto. The handle tube, which in the region of the inserted inner bushing is cylindrical, can be formed in an arc shape adjacent thereto, for example as a 90° arc. The handle tube may also be conical in the region of the inner bushing.

Preferably, the wall opening of the handle tube can be designed as a slot-shaped cutout which passes around approximately half the circumference of the handle tube and the end faces of which are arranged approximately diametrically opposite one another in the relative starting position of the handle arrangement and suction hose.

The receiving space for the flexible liquid line on the outer circumference of the inner bushing is advantageously designed in such a way that it is delimited in the axial direction by two spaced-apart flange-like annular protrusions of the inner bushing and is delimited in the radial directions towards the outside by the inner wall surface of the handle tube and towards the inside by the outer circumferential surface of the inner bushing.

In the case of a hose which has, in a manner known per se, corrugation peaks and corrugation troughs running helically around the outside in the manner of an outer thread, the rotationally fixed attachment of the inner bushing to the. suction hose end advantageously takes place in such a way that the suction hose pushed onto the inner bushing is pressed against one annular protrusion by a threaded sleeve screwed onto the hose, which threaded sleeve engages over the annular protrusion and has a stop element pointing radially outwards. Here, the threaded sleeve has an inner threaded section which, in terms of dimensions and pitch, is adapted to the outer thread of the hose formed by the corrugation peaks and corrugation troughs.

In a further embodiment of the handle arrangement according to the invention, the stop element of the threaded sleeve, is located within the wall opening of the handle tube, wherein the two end faces of the wall opening are the stop faces for the stop element which delimit the rotation angle between the suction hose and the handle tube.

Advantageously, the liquid line of the suction hose, before entering the inner bushing, is located in a tube which extends into the wall opening of the handle tube and is placed in a receiving channel of the inner bushing which extends in the axial direction and is integrally formed in the wall of the inner bushing so as to be open towards the outside. Instead of passing the liquid line through a tube, the liquid line may also be glued or welded directly onto the inner wall of the suction hose.

For sealing between the inner bushing and the handle tube which can rotate to a limited extent relative thereto, it is provided that the inner bushing has at its end remote from the suction hose an annular step on which a lipped sealing ring is held, the sealing lip of which bears against the inner wall surface of the handle tube.

BRIEF DESCRIPTION OF THE DRAWINGS

Further details of the invention will be explained in more detail with reference to the drawings which show a preferred example of embodiment. In the drawings.

The drawings are shown to different scales in order to illustrate details and functional relationships.

DETAILED DESCRIPTION OF THE PREFERRED EMBODIMENT

Figure 1:
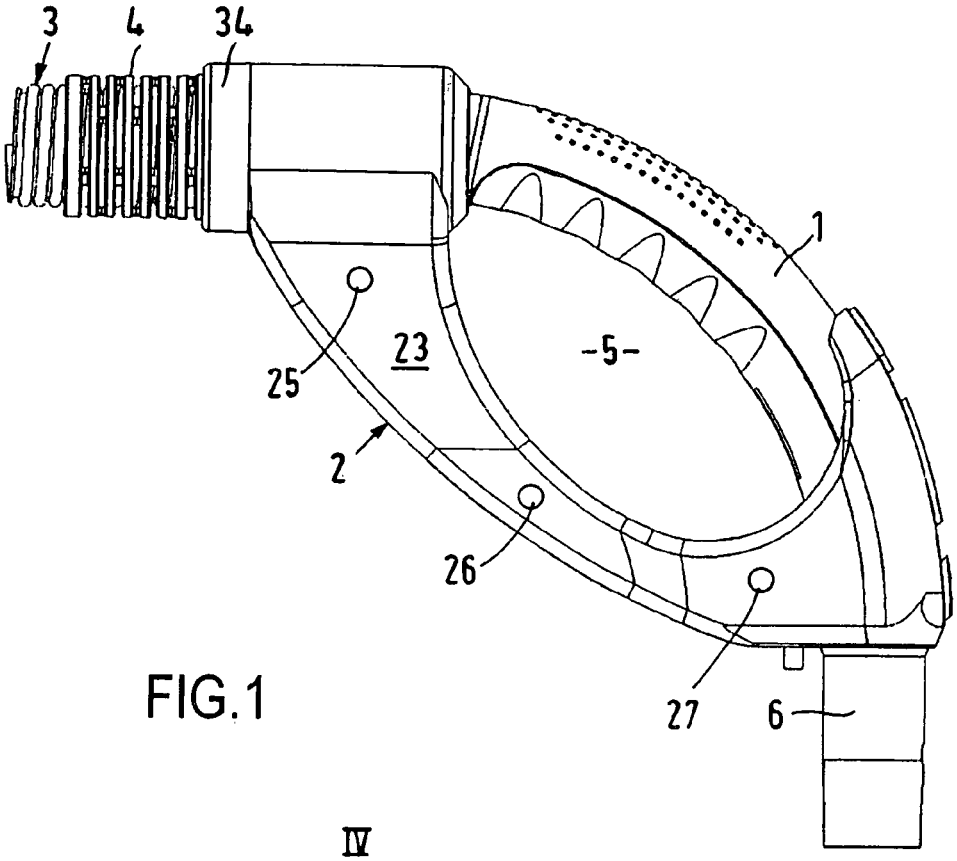
FIG. 1 shows a side view of the handle arrangement with the vacuum cleaner hose shown broken off.

Of the handle arrangement, only a few parts can be seen from outside in FIG. 1, namely the handle tube 1, the handle part 2, the suction hose 3 and a cage-like anti-kink means 4 for the suction hose 3, said anti-kink means being connected to the handle arrangement. The handle tube 1 is designed in an arc shape as a handle and describes an arc of approximately 90°. The handle part 2 is also shaped as an arc, but opposite to the arc shape of the handle tube 1, so that a through-opening 5 is formed between the handle tube 1 and the handle part 2. The handle part 2 is at one side connected to the hose-side end of the handle tube 1 and at the other side is also connected to the other end of the handle tube 1, which merges into a connector 6 for a nozzle (not shown) or connection tube (not shown).

Figure 2:
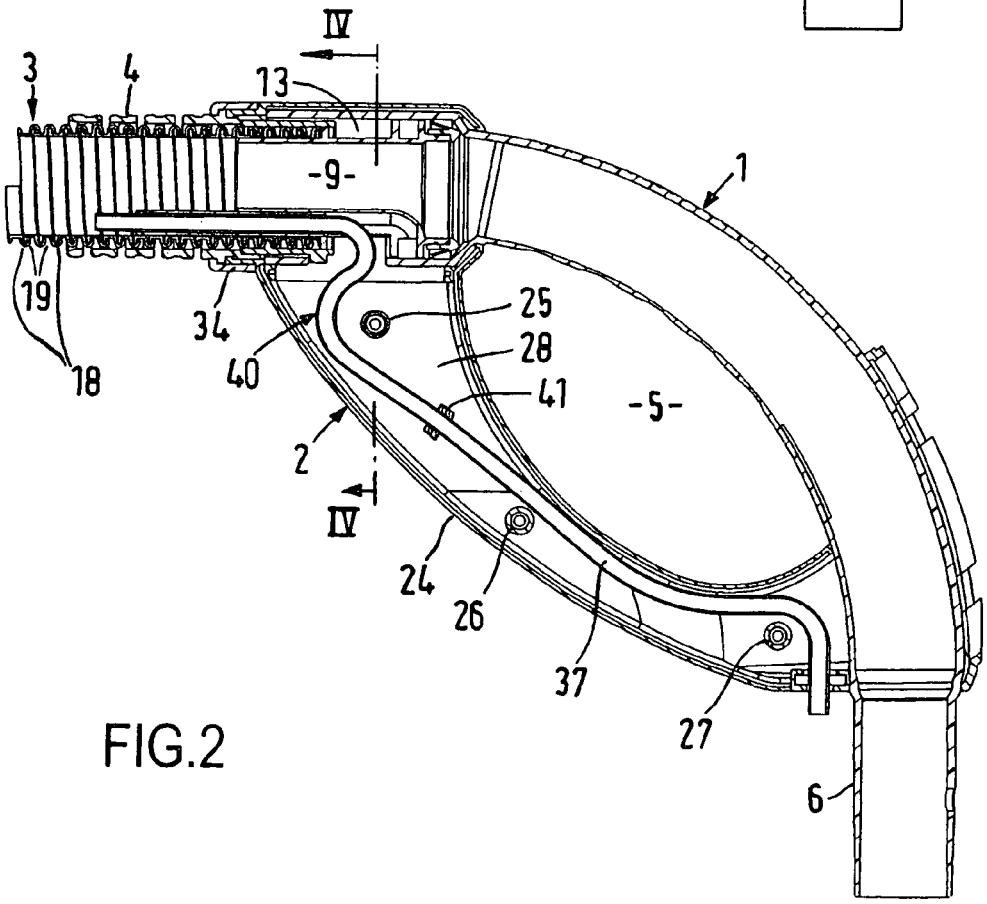
FIG. 2 shows the arrangement according to FIG. 1, but in longitudinal section.
Figure 3:
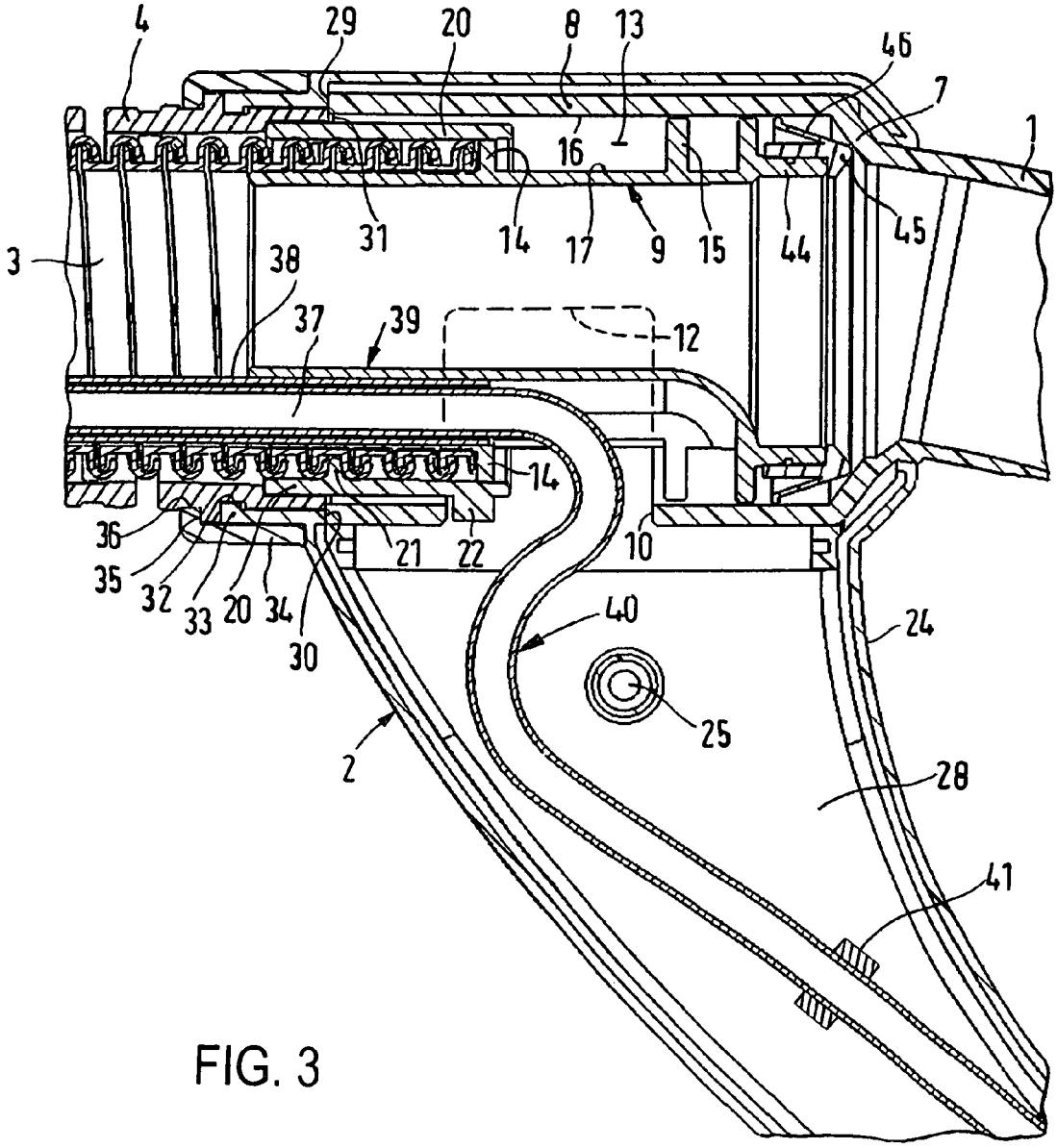
FIG. 3 shows a detail of the longitudinal section through the arrangement, shown on an enlarged scale compared to FIG. 2.
Figure 4:
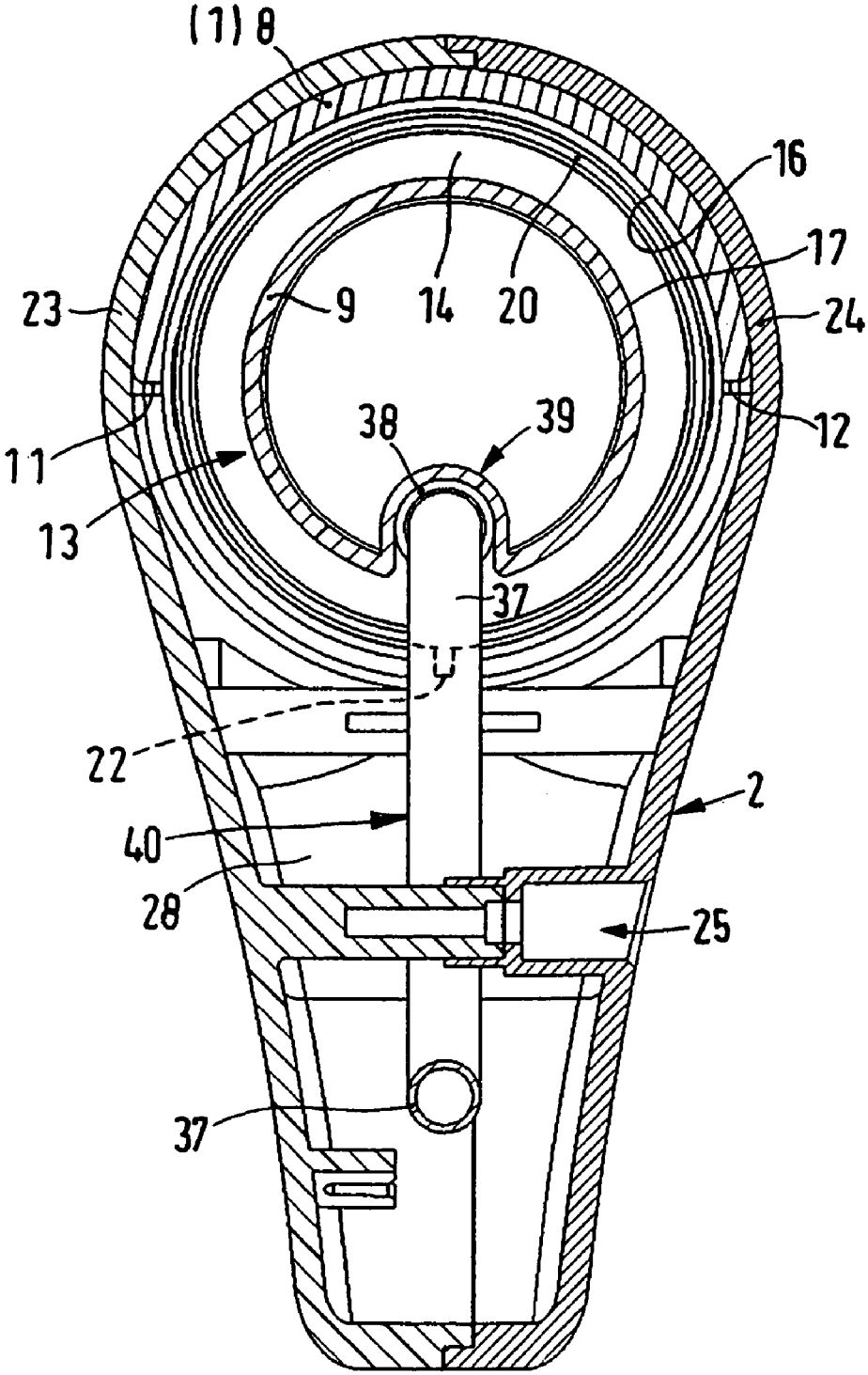
FIG. 4 shows the cross-section through the arrangement along the section line IV-IV in FIG. 2, showing the relative starting position of the inner bushing with respect to the handle tube.

As can be seen in particular from FIGS. 2 and 3, the handle tube 1 widens at a conical transition 7 to form a cylindrical end section 8 of larger diameter, in which the inner bushing 9 is inserted. Provided in the end section 8 of the handle tube 1 is a wall opening 10 which is designed as a wide slot-shaped cutout which passes around approximately half the circumference of the handle tube 1. The end faces 11 and 12 (FIGS. 3, 4) of the wall opening 10 are arranged approximately diametrically opposite one another in the relative starting position of the handle arrangement and hose 3 (FIG. 4).

Provided on the outer circumference of the inner bushing 9 is a receiving space 13 which is arranged opposite the wall opening 10 and is delimited in the axial direction by two spaced-apart flange-like annular protrusions 14 and 15 and is delimited in the radial directions towards the outside by the inner wall surface 16 of the cylindrical end section 8 of the handle tube 1 and towards the inside by the outer circumferential surface 17 of the inner bushing 9. The function of the receiving space 13 will be explained in more detail below.

The suction hose 3 has, in the conventional manner, alternating corrugation peaks 18 and corrugation troughs 19 running helically in the manner of an outer thread. The hose 3 is pushed onto the inner bushing 9 until it bears against the annular protrusion 14 and is pressed against the annular protrusion 14 by a threaded sleeve 20 screwed onto the hose 3, as a result of which the hose 3 is non-rotatably fixed to the inner bushing 9 so that the latter together with the hose 3 can rotate relative to the handle tube 1. The threaded sleeve 20 has for example a complete inner thread 21 which has the same pitch as the outer thread on the hose 3 formed by the corrugation peaks 18 and corrugation troughs 19, and is shown in section in FIG. 3.

The threaded sleeve 20 engages over the annular protrusion 14 and has on its outer circumferential surface a stop element 22 pointing radially outwards, which stop element is located within the wall opening 10 as shown in FIG. 3. The two end faces 11 and 12 of the wall opening 10 form the stop faces for the stop element 22 which delimit the possible rotation angle between the inner bushing 9 and the handle tube 1.

The handle part 2 is formed of two half-shells 23 and 24 which partially tightly surround the handle tube 1 and its cylindrical end section 8, as shown in FIGS. 2 to 6. The half-shells 23, 24 are also connected to the other end of the handle part 1 (FIGS. 1, 2), are firmly connected to one another at fixing points 25 to 27 and form a cavity 28 passing through the handle part 2.

As shown in FIG. 3, the two half-shells 23, 24, of which only the half-shell 24 can be seen in this figure, bear with an annular step 29 against the end face 30 of the cylindrical section 8 of the handle tube 1. The anti-kink means 4 also bears against the end face 30 with its inner end 31 which engages over the threaded sleeve 20. Located in the anti-kink means 4 is a circumferential groove 32, in which there engages a protrusion 33 located around the circumference of the two half-shells 23, 24. A latching ring 34 is pushed onto the hose-side end of the two half-shells 23, 24 and latches with a radially inwardly directed protrusion 35 into an associated groove 36 on the circumference of the anti-kink means 4.

Due to this design and arrangement of the engaging parts of the handle arrangement, the inner bushing 9, the hose 3, the anti-kink means 4 and the threaded sleeve 20 are arranged such that they can rotate together relative to the handle tube 1 with its cylindrical end section 8, the handle part 2 and the latching ring 34. However, the inner bushing 9 with the hose 3, the anti-kink means 4 and the threaded sleeve 20 are fixed such that they cannot be displaced in the axial direction with respect to the handle tube 1, the handle part 2 and the latching ring 34. In a manner differing from the illustrated arrangement described above, the anti-kink means 4 may also be firmly connected to the handle tube.

Guided through the hose 3 is a liquid line 37 which, before entering the inner bushing 9, is located in a tube 38 which extends into the wall opening 10 of the cylindrical end section 8 of the handle tube 1, as can be seen in particular in FIG. 3. The tube 38 is placed in a receiving channel 39 of the inner bushing 9 which extends in the axial direction and is integrally formed in the wall of the inner bushing 9 so as to be open towards the outside.

The liquid line 37 is guided outwards from the hose 3 and the inner bushing 9, more specifically from the tube 38 placed in the receiving channel 39 of the inner bushing 9, in an approximately radial direction through the wall opening 10 of the handle tube 1, more specifically the cylindrical end section 8 of the handle tube 1, and into the cavity 28 of the handle part 2 and is fixed there by a line holder 41 so as to form an approximately S-shaped length reserve loop 40, said line holder being arranged between the fixing points 25 and 26.

Figure 5:
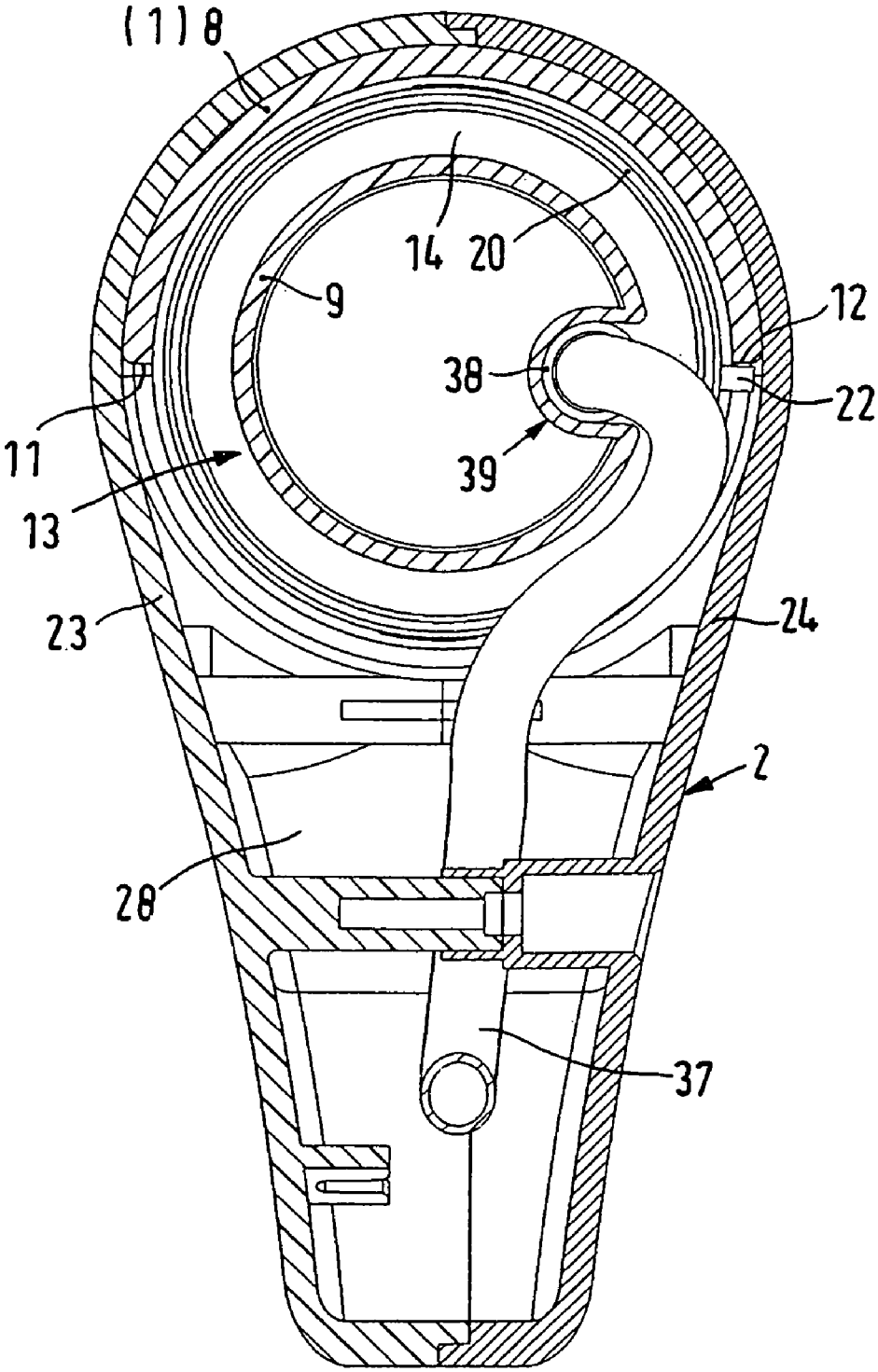
FIG. 5 shows a cross-section according to FIG. 4, but with an inner bushing which has been rotated relative to the handle tube by approximately 90° in one direction of rotation as far as the stop position.
Figure 6:
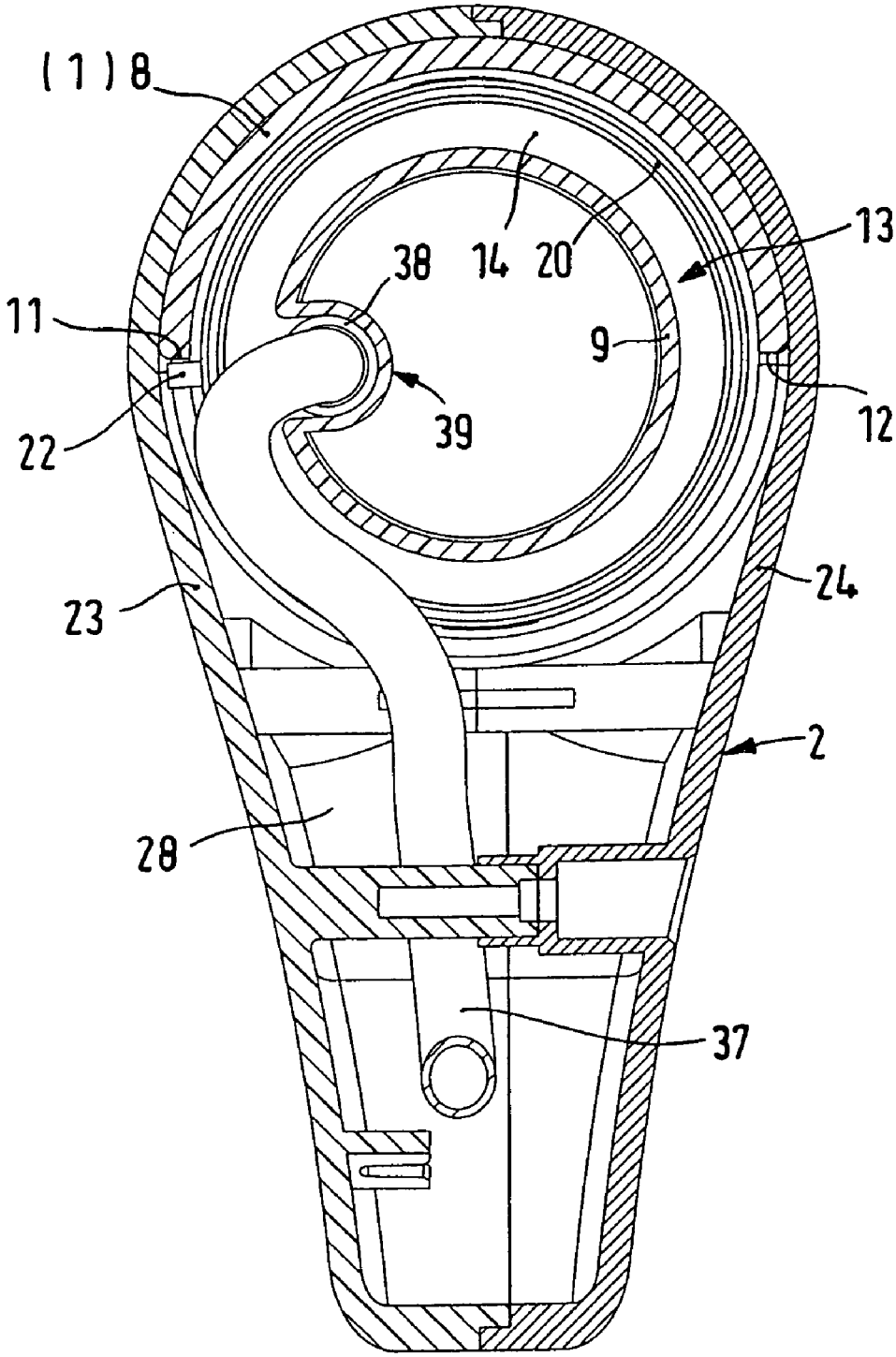
FIG. 6 shows a cross-section according to FIG. 4, but with an inner bushing which has been rotated relative to the handle tube by approximately 90° in the other direction of rotation as far as the stop position.

In the case of relative rotations between the hose 3, including the parts connected in rotation therewith, and the handle tube 1, including the parts connected in rotation therewith, the liquid line 37 is shifted from the length reserve loop 40 partially into the receiving space 13, as shown in FIGS. 5 and 6. These figures also illustrate the maximum possible rotation angle in both directions of rotation, at which the stop element 22 bears against either the end face 11 (FIG. 6) or the end face 12 (FIG. 5) of the wall opening 10.

After the line holder 41, the liquid line 37 is guided through the cavity 28 of the handle part 2, as can be seen from FIG. 2, and at the end of the cavity 28 can be connected in a suitable manner to a spray nozzle or the like.

As can be seen most clearly from FIG. 3, the inner bushing 9 has an annular step 44 at its end remote from the hose 3. The annular step 44 holds a lipped sealing ring 45, the sealing lip 46 of which bears against the inner wall surface 16 of the cylindrical end section 8 of the handle tube 1 and thus seals off the vacuum chamber from the external atmosphere.

The handle tube 1, the handle part 2, the anti-kink means 4 and the threaded sleeve 20 may be produced by injection molding from thermoplastic plastics of suitable strength.

In summary, a handle arrangement is prepared on a suction hose 3 equipped for spray extraction, which has corrugation peaks 18 and corrugation troughs 19 running helically around the outside in the manner of an outer thread. However, the handle arrangement can also be used for hoses on which the corrugation peaks and corrugation troughs serving for hose elasticity do not run helically on account of a different production method, but instead are arranged as alternating rings. The handle arrangement can also be adapted for use on smooth-walled hoses. An inner bushing 9 is attached in a suitable manner to one end of the hose 3 such that it cannot rotate relative to the hose 3, and is inserted in a handle tube 1 and fixed therein such that it can rotate but cannot be displaced in the axial direction. An elastic liquid line 37 is guided outwards from the hose 3 and the inner bushing 9 in a radial direction through a wall opening of the handle tube 1 and into the cavity 28 of a handle part 2. The handle part 2 is firmly connected at both ends to the handle tube 1. The liquid line 37 is fixed so as to form a length reserve loop 40 in the cavity 28. A receiving space 13 is provided on the inner bushing 9, into which the liquid line 37 from the length reserve loop 40 is shifted when relative rotations take place between the hose 3 and the handle tube 1. The possible rotation angle is optionally delimited here by stops according to the line length available in the length reserve loop 40, but may also be delimited by the line length available in the length reserve loop 40 itself, i.e. even without stops.

Variations and modifications are possible without departing from the scope and spirit of the present invention as defined by the appended claims.

We claim:

1. A handle arrangement on a suction hose, in particular equipped for spray extraction, comprising an inner bushing which is attached to one end of the suction hose such that it cannot rotate relative to the suction hose and comprising a handle tube in which the inner bushing is inserted and is fixed therein in a sealed manner such that it can rotate but cannot be displaced in the axial direction, wherein a flexible liquid line is guided outwards from the suction hose and the inner bushing in an approximately radial direction through a wall opening of the handle tube and into a cavity of a handle part which is connected to the hose-side end of the handle tube, wherein the liquid line is fixed so as to form a length reserve loop in the handle part, wherein a receiving space is provided on the outer circumference of the inner bushing, which receiving space is located opposite the wall opening of the handle tube and into which the liquid line from the length reserve loop can be shifted in the case of relative rotations between the suction hose and the handle tube, and wherein there is provided a rotation angle between the suction hose and the handle tube which rotation angle is delimited according to the length of the liquid line in the length reserve loop.

2. A handle arrangement according to claim 1, wherein the rotation angle between the suction hose and the handle tube is delimited by stops.

3. A handle arrangement according to claim 1, wherein the handle part is formed of two half-shells which at one side partially tightly surround the handle tube at its suction-hose-side end and at the other side are also connected to the other end of the handle part, wherein the two half-shells form a cavity passing through the handle part, through which cavity the liquid line is guided and is fixed in the vicinity of the handle tube by a line holder.

4. A handle arrangement according claim 1, wherein the handle tube, which in the region of the inserted inner bushing is designed as a cylindrical end section, is formed in an arc shape adjacent thereto.

5. A handle arrangement according to claim 1, wherein the wall opening of the handle tube is designed as a slot-shaped cutout with end faces, the cutout passing around approximately half the circumference of the handle tube and the end faces of the cutout being arranged approximately diametrically opposite one another in the relative starting position of the handle arrangement and suction hose.

6. A handle arrangement according to claim 1, wherein the receiving space on the outer circumference of the inner bushing is delimited in the axial direction by two spaced-apart, flange-like, annular protrusions of the inner bushing and is delimited in radial directions towards the outside by the inner wall surface of the handle tube and towards the inside by the outer circumferential surface of the inner bushing.

7. A handle arrangement according to claim 6, wherein the suction hose has corrugation peaks and corrugation troughs running helically around the outside in the manner of an outer thread, and wherein the suction hose pushed onto the inner bushing is pressed against one annular protrusion by a threaded sleeve screwed onto the suction hose, which threaded sleeve engages over said one annular protrusion and has a stop element pointing radially outwards.

8. A handle arrangement according to claim 7, wherein the stop element of the threaded sleeve is located within the wall opening of the handle tube, wherein the two end faces of the wall opening are the stop faces for the stop element which delimit the rotation angle between the suction hose and the handle tube.

9. A handle arrangement according to claim 1, wherein the liquid line of the suction hose, before entering the inner bushing, is located in a tube which extends into the wall opening of the handle tube and is placed in a receiving channel of the inner bushing which extends in the axial direction and is integrally formed in the wall of the inner bushing so as to be open towards the outside.

10. A handle arrangement according to claim 1, wherein the inner bushing has at its end remote from the suction hose an annular step on which a lipped sealing ring is held, the sealing lip of which bears against the inner wall surface of the handle tube.

* * * * *